US011827493B2

(12) United States Patent
Wang

(10) Patent No.: US 11,827,493 B2
(45) Date of Patent: Nov. 28, 2023

(54) ELEVATOR SAFETY SYSTEM AND ELEVATOR EQUIPMENT

(71) Applicant: Otis Elevator Company, Farmington, CT (US)

(72) Inventor: Wei Wang, Shanghai (CN)

(73) Assignee: OTIS ELEVATOR COMPANY, Farmington, CT (US)

( * ) Notice: Subject to any disclaimer, the term of this patent is extended or adjusted under 35 U.S.C. 154(b) by 0 days.

(21) Appl. No.: 17/828,790

(22) Filed: May 31, 2022

(65) Prior Publication Data

US 2023/0027334 A1 Jan. 26, 2023

(30) Foreign Application Priority Data

Jul. 21, 2021 (CN) ..... 202110824368.X

(51) Int. Cl.
*B66B 5/16* (2006.01)

(52) U.S. Cl.
CPC ..... *B66B 5/16* (2013.01)

(58) Field of Classification Search
CPC ..... B66B 5/16; F16H 19/04
See application file for complete search history.

(56) References Cited

U.S. PATENT DOCUMENTS 4,998,860 A * 3/1991 Dehne ..... F16H 19/04 74/29
6,318,505 B1 * 11/2001 De Angelis ..... B66B 11/0293 187/292
7,849,972 B2 * 12/2010 Higashinaka ..... B66B 5/18 187/373
8,631,909 B2 * 1/2014 Draper ..... B66B 5/06 187/373
9,457,990 B2 * 10/2016 Osmanbasic ..... B66B 5/20
9,511,977 B2 * 12/2016 Schautt ..... B66B 5/24
2008/0128218 A1 * 6/2008 Gremaud ..... B66B 5/22 187/250
2012/0152663 A1 6/2012 Legeret et al.
2015/0308527 A1 * 10/2015 Nagel ..... F16H 1/225 74/89.14

(Continued)

FOREIGN PATENT DOCUMENTS

CN 104564925 B * 4/2018 ..... F16D 63/008
CN 109081216 A 12/2018
KR 100643909 B1 11/2006

OTHER PUBLICATIONS

European Search Report for Application No. 22185262.7; dated Dec. 14, 2022; 5 Pages.

*Primary Examiner* — Michael R Mansen
*Assistant Examiner* — Michelle M Lantrip
(74) *Attorney, Agent, or Firm* — CANTOR COLBURN LLP

(57) ABSTRACT

An elevator safety system and elevator equipment. The elevator safety system includes a safety unit which has a safety device and a trigger, the trigger is connected with the safety device and outputs an acting force from its output end to the safety device for actuating the safety device to perform safety operation to the elevator, the safety unit further includes a force amplifying device provided between the trigger and the safety device for amplifying the acting force output from the output end and then transmitting the amplified acting force to the safety device.

11 Claims, 2 Drawing Sheets

(56) References Cited

U.S. PATENT DOCUMENTS

| | | | | |
|---|---|---|---|---|
| 2018/0172093 | A1* | 6/2018 | Schedl | F16H 35/00 |
| 2021/0010574 | A1* | 1/2021 | Lee | F16H 57/039 |
| 2022/0059934 | A1* | 2/2022 | Ai | H01P 1/18 |

* cited by examiner

ELEVATOR SAFETY SYSTEM AND ELEVATOR EQUIPMENT

FOREIGN PRIORITY

This application claims priority to Chinese Patent Application No. 202110824368.X, filed Jul. 21, 2021, and all the benefits accruing therefrom under 35 U.S.C. § 119, the contents of which in its entirety are herein incorporated by reference.

FIELD OF THE INVENTION

The present disclosure relates to the technical field of elevators, and in particular to an elevator safety system and elevator equipment comprising the elevator safety system.

BACKGROUND OF THE INVENTION

In modern society, various types of elevator equipment are widely used in many places and environments. However, due to various reasons, these elevator equipment may have safety issues during use, and may endanger the operation of the equipment and personal property safety and so on, so it should not be ignored.

To this end, in the prior art, it provides many equipment and technical means involving such safety issues to provide protection. For example, safety means such as safety gears are generally installed in current elevator equipment. Once an abnormal situation such as overspeeding or exceeding a limit height occurs when the elevator is running is detected, it may immediately carry out operations such as speed limiting and braking to the elevator car by such safety devices, so as to avoid undesired accidents such as equipment damage and personal injury.

When the above-mentioned abnormal situation occurs, usually, a trigger generates a triggerring action and provides an acting force to a safety device such as a safety gear so as to actuate the latter to work. However, the magnitude of such acting force is usually limited, for example, it can generally reach up to about 40 N. In some applicable situations, for example, it is often hard to meet the requirements of use and cannot provide stable and reliable working performance when a relatively larger force is required. In addition, if it is considered to use two or more devices such as triggers and safety gears in elevator equipment at the same time, these devices may have problems in terms of synchronization operability, redundancy reliability, etc., which are unsatisfactory.

SUMMARY OF THE INVENTION

In view of the foregoing, the present disclosure provides an elevator safety system and elevator equipment, so as to solve or at least alleviate one or more of the above-mentioned problems and other problems in the prior art.

First, according to one aspect of the present disclosure, an elevator safety system is provided, which comprises a safety unit having a safety device and a trigger, the trigger is connected with the safety device and outputs an acting force from its output end to the safety device for actuating the safety device to perform safety operation to the elevator, wherein the safety unit further comprises a force amplifying device provided between the trigger and the safety device for amplifying the acting force output from the output end and then transmitting the amplified acting force to the safety device.

In the elevator safety system according to the present disclosure, optionally, the force amplifying device is a rack and gear transmission mechanism, which comprises: a gear set having at least a first gear and a second gear; a first rack meshed with the first gear and connected with the output end; and a second rack meshed with the second gear and connected with the safety device to transmit the amplified acting force thereto.

In the elevator safety system according to the present disclosure, optionally, the rotation shaft of the first gear and the rotation shaft of the second gear are coaxial, and the gear diameter ratio between the first gear and the second gear is greater than 1.

In the elevator safety system according to the present disclosure, optionally, the first gear and the second gear are meshed with each other and their respective rotation shafts are parallel, and the gear ratio between the first gear and the second gear is less than 1.

In the elevator safety system according to the present disclosure, optionally, the first rack has a slot extending in its length direction, and the output end has a connecting part for matching the slot to make the output end slidably connected with the first rack through the slot.

In the elevator safety system according to the present disclosure, optionally, the second rack has a hole through which the safety device is connected to the second rack.

In the elevator safety system according to the present disclosure, optionally, the elevator safety system is provided with at least two safety units.

In the elevator safety system according to the present disclosure, optionally, the elevator safety system further comprises a synchronization device arranged between the at least two safety units for enabling the safety devices in the at least two safety units to synchronously receive the amplified acting force transmitted from the corresponding force amplifying devices respectively and perform safety operation to the elevator.

In the elevator safety system according to the present disclosure, optionally, the synchronization device comprises:

at least two connecting arms, each connecting arm having a first end installed and connected between the corresponding force amplifying device and safety device in the at least two safety units, and a second end; and a connecting bar connected with the respective second ends of the at least two connecting arms.

In the elevator safety system according to the present disclosure, optionally, the elevator safety system has a first safety unit and a second safety unit, which are respectively arranged on two sides of an elevator car, and the connecting bar traverses through a bottom frame of the elevator car.

In the elevator safety system according to the present disclosure, optionally, the safety device, the trigger, and the force amplifying device are provided on an elevator car, and the trigger is configured to be triggered in response to change of elevator operation parameters.

Secondly, according to another aspect of the present disclosure, there is also provided an elevator equipment, which comprises: an elevator hoiltway with a guide rail; at least one elevator car arranged to run in the elevator hoistway along the guide rail; and the elevator safety system as described in any one of the above, which is configured to perform safety operation to the elevator car by the safety device in the elevator safety system.

From the following detailed description in conjunction with the accompanying drawings, the principles, features, characteristics, and advantages of each of the technical solutions according to the present disclosure will be clearly understood. The application of the solutions of the present disclosure can overcome or at least alleviate the defects and shortcomings exist in the prior art elevator safety devices, and in particularly can provide sufficient and effective acting force to actuate the elevator safety devices very conveniently, stably and reliably. Therefore, the elevator safety devices can be applied to a wider application environment. In addition, the present disclosure can also effectively realize the synchronous operation of multiple elevator safety devices. Especially, even in the event that a part of the elevator safety devices fail, the elevator safety operation can still be completed reliably, so that it is very helpful to improve the existing elevator safety device functions and enhance the safety performance of elevator equipment. The structure of the invention is simple, and it is easy to install and use, and is very suitable for extensive use.

BRIEF DESCRIPTION OF THE DRAWINGS

The technical solutions of the present disclosure will be described in further detail below with reference to the accompanying drawings and embodiments. However, it should be understood that these drawings are designed merely for the purpose of explanation and only intended to conceptually illustrate the structural configurations described herein, and are not required to be drawn to scale.

DETAILED DESCRIPTION OF THE EMBODIMENT(S) OF THE INVENTION

Firstly, it should be noted that the structure, components, characteristics, advantages and the like of the elevator safety system and the elevator equipment according to the invention will be described below by way of example. However, it should be understood that neither of the descriptions should be understood as limiting the invention in any way. Herein, the technical terms "first" and "second" are only used for distinguishing purposes and are not intended to indicate their order and relative importance. The technical term "connect (or interconnect, etc.)" covers the situations that one component is directly and/or indirectly connected the other component, the form of connection may adopt any feasible form of connection such as connector (such as bolts, screws, pins, etc.) connection, weld connection, rivet connection, and the like.

In addition, for any single technical feature described or implied in the embodiments mentioned herein, or any single technical feature shown or implied in individual drawings, the present disclosure still allows for any further combination or deletion among these technical features (or equivalents thereof) without any technical obstacle. Therefore, it should be considered that more embodiments according to the invention should also fall within the scope recorded in this document. In addition, for the sake of brevity, general matters what were already known to those skilled in the art, e.g., the basic structure and working principle of components such as safety gears, triggers commonly used in the elevator field, will not be repeated herein.

Figure 1:
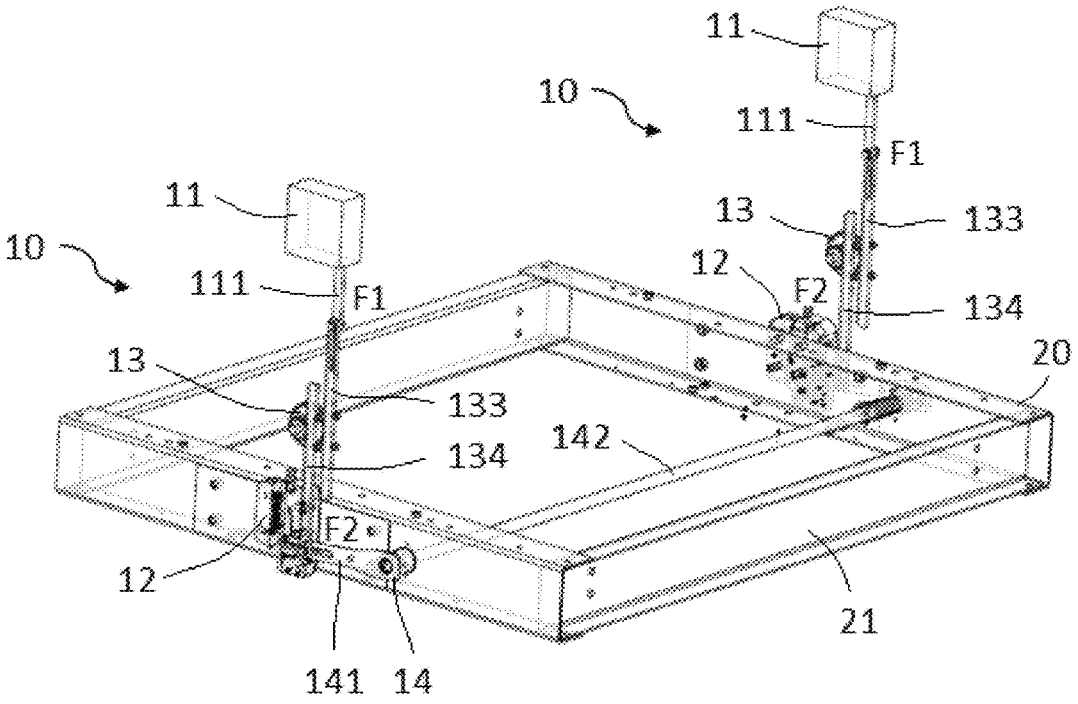
FIG. 1 is a structural schematic perspective view of an embodiment of an elevator safety system according to the present disclosure installed to an elevator car in an elevator example.

FIG. 1 exemplarily illustrates the general structural composition that an embodiment of the elevator safety system according to the present disclosure has been installed on an elevator car. In order to simplify the drawing, it is only schematically shown in FIG. 1 a part of the bottom frame structure of the elevator car, and the trigger in the embodiment of the elevator safety system is further omitted in FIG. 2. Hereinafter, the solution of the present disclosure will be introduced in detail by way of this embodiment.

Figure 2:
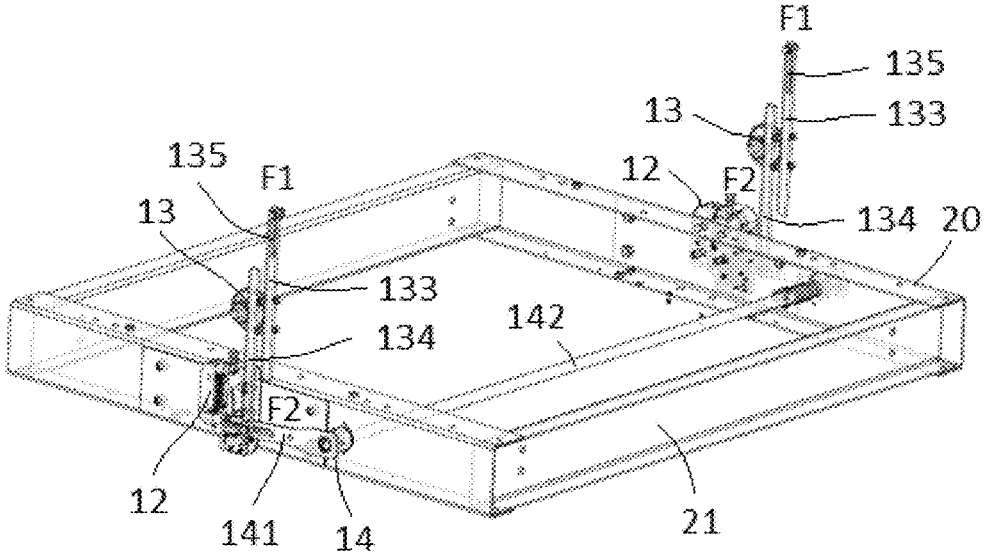
FIG. 2 is a structural schematic perspective view with the trigger shown in FIG. 1 removed.

As shown in FIGS. 1 and 2, two safety units 10 are configured in this embodiment of the elevator safety system. For example, they may be arranged on both sides of the elevator car 20, and each of the safety units 10 may comprises a trigger 11, a safety device 12, and a force amplifying device 13.

Specifically, the trigger 11 is used cooperatively with the safety device 12, and may be set to be triggered to work in response to the changes in elevator operation parameters, and thereby output acting force to the safety device 12. Regarding the above-mentioned elevator operation parameters, it may include, but is not limited to, for example, the current running speed of the elevator car, the current running position of the elevator car, etc. In this way, the corresponding data may be obtained by means of detecting devices such as speed sensors and position sensors, and such data may also be obtained from, for example, an elevator control system. When such elevator operation parameters exceed their respective thresholds, the trigger 11 may be actuated and triggered to work.

As to the acting force output after the trigger 11 is triggered, it will be directly applied to safety devices such as safety gears according to the existing technical solution, so as to prompt the latter to immediately implement various possible elevator safety operations, such as the operations like decelerating the elevator car and stopping the elevator car, in order to avoid undesired situations such as the occurrence of equipment property damage and personal injury accidents.

However, the inventor of the present application has discovered that the above-mentioned acting force directly output to safety devices such as safety gears may be insufficient in some applicable situations, it is particularly apparent especially in some cases where the provision of a relatively large acting force is required to prompt the safety device to form a stable and reliable elevator safety operation. In this regard, the industry participants are always accustomed to directly improving the design of the trigger so that it can output a relatively larger acting force that meet the requirements for actuating the safety device, thus forming various types of trigger products.

Being different from the prior art, the solution of the present disclosure solves the above problems by innovatively providing an additional force amplifying device 13, instead of redesigning a trigger and other devices. In this way, these original devices in the elevator equipment can be fully utilized without major design changes and installation transformations, thereby effectively simplifying the corresponding investment in product design management, quality control, and equipment installation.

For the force amplifying device 13, as shown in FIGS. 1 and 2, it may be arranged between the trigger 11 and the safety device 12 so as to be used for amplifying the acting force F1 output from the output end 111 of the trigger 11 into a relatively larger acting force F2, the acting force F2 is then transmitted to the safety device 12, so that the latter may be provided with a more demanding force, which will help the safety device 12 to be more reliably and more stably provide elevator safety operation, effectively guarantee the safe operation of the elevator equipment, and effectively avoid damage to personnel and equipment caused by untimely and unreliable elevator safety operation.

Figure 3:
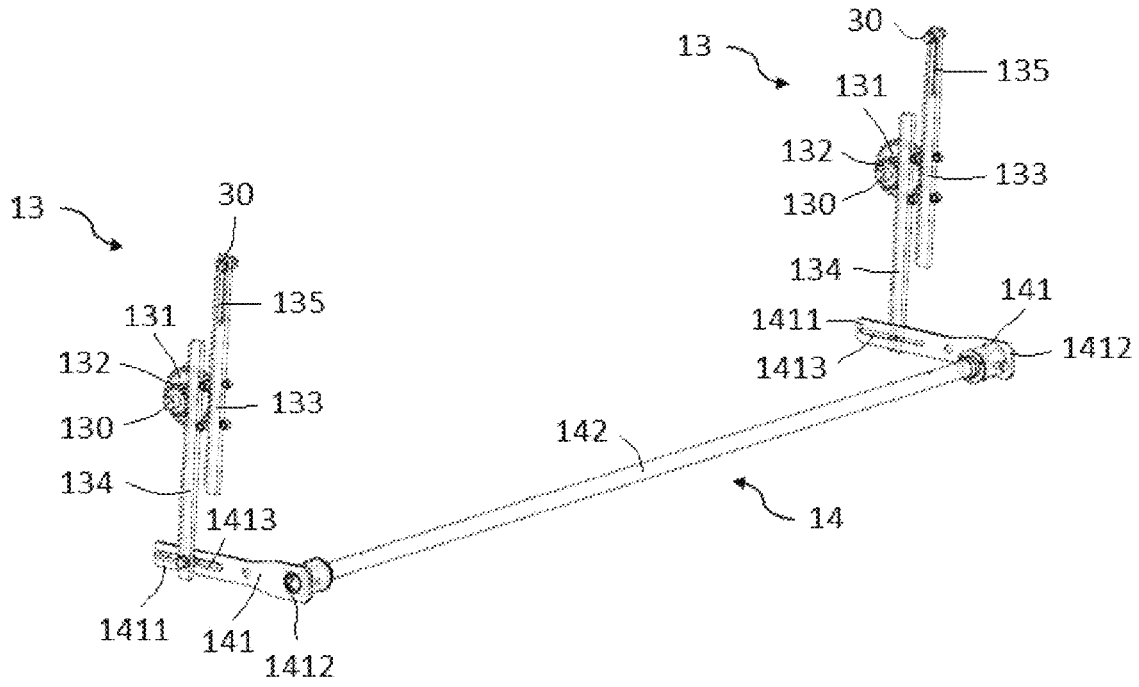
FIG. 3 is a structural schematic perspective view of the embodiment of the elevator safety system shown in FIG. 1.
Figure 4:
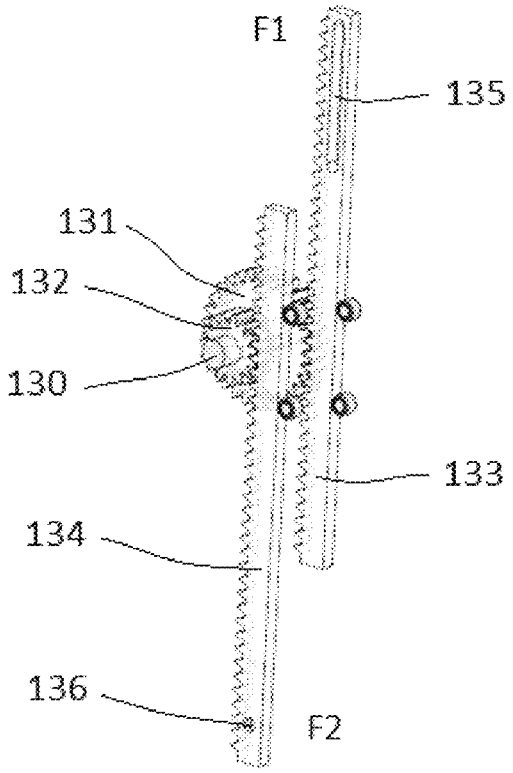
FIG. 4 is a structural schematic perspective view of a rack and gear transmission mechanism in the embodiment of the elevator safety system shown in FIG. 1.

With reference to FIGS. 3 and 4, a specific embodiment of the force amplifying device 13 is shown in these two figures. In this embodiment, the force amplifying device 13 may take the form of a rack and gear transmission mechanism. The rack and gear transmission mechanism may comprise a first rack 133, a second rack 134, and a gear set consisting of a first gear 131 and a second gear 132.

Specifically, one end of the first rack 133 is connected to the output end 111 of the trigger 11, so as to receive the acting force F1 output from the output end 111 after the trigger 11 is triggered. A part of each of the first rack 133 and the second rack 134 respectively mesh with the first gear 131 and the second gear 132, and one end of the second rack 134 is connected to the safety device 12 so as to transmit the acting force F2 amplified by the amplifying device 13.

In this example, both the first gear 131 and the second gear 132 are constructed to have a common rotation shaft 130, that is, they are coaxial gears; at the same time, the gear diameters of the first gear 131 and the second gear 132 are not the same. More specifically, the gear diameter of the first gear 131 is larger than the gear diameter of the second gear 132, that is, the gear diameter ratio at this time is greater than one. When the first gear 131 and the second gear 132 rotate at the same rotating speed around the rotation shaft 130, according to the law of conservation of energy, except the inevitable efficiency loss, since the diameter of the former is larger than the diameter of the latter, the acting force F2 transmitted by the second gear 132 will be greater than the force F1 input by the first gear 131, thereby achieving the effect of force amplification.

According to different application requirements, the required force amplifying scale, that is, the amplifying scale from the original acting force F1 to the finally output acting force F2, may be determined by selectively adjusting the specific value of the gear diameter ratio. For example, the amplifying scale may be 1.5 times, 2 times, 2.5 times, 3 times, 4 times, etc., the present disclosure does not put any limitation on this.

As another example, in some optional embodiments, the first gear 131 and the second gear 132 may be arranged to mesh with each other, and their respective rotation shaft may be arranged parallel to each other. At the same time, the gear ratio between the first gear 131 and the second gear 132 may be set to be less than 1, so as to be able to provide the safety device 12 with the desired amplified and relatively larger acting force F2. Regarding the specific force amplifying scale, it may be determined by selectively adjusting the specific value of the aforementioned gear ratio, and the present disclosure also does not put any limitation on this.

It should be understood that since the gear set may have very flexible and diverse constructions, a multi-stage gear arrangement may be formed by adding one or more gears in addition to the above two gears, which can also provide any feasible force amplifying scale. Those skilled in the art may carry out the corresponding designs according to the above design ideas of the present disclosure, so the present disclosure will not be extensively discussed here.

Proceeding to refer to FIGS. 3 and 4, corresponding structures may be provided at the first rack 133 and the second rack 134 for connecting with the trigger 11 and the safety device 12, respectively.

As an exemplary illustration, for the first rack 133, a slot 135 may be formed thereon in the length direction, and a connecting portion (such as a hole, a protrusion, etc.) matched with the slot 135 may be provided at the output end 111 of the trigger 11, so that the two of the trigger 11 and the first rack 133 may be slidably connected together by a connecting member 30 such as bolt, pin, etc., that is, the output end 111 of the trigger 11 can move relative to the first rack 133 within the length range of the slot 135, which is beneficial for avoiding jamming of the above components during use and improving the overall operation reliability of the system. In practical applications, the specific size, arrangement position, and length setting range etc. of the slot 135 may be flexibly selected and set according to specific application requirements.

In addition, for the second rack 134, one or more holes 136 may be provided at any suitable position on the rack, so that the safety device 12 and the second rack 134 can be connected together through such kinds of hole structure. Thus, the amplified acting force F2 may be transmitted to the safety device 12 when the trigger 11 and the force amplifying device 13 are working.

According to the solution of the present disclosure, two, three or more safety units 10 may be arranged in elevator equipment at the same time in some applicable situations, so as to provide reliable safety redundancy and enhance the safety and reliability of elevator equipment. For example, in the embodiment of the elevator safety system shown in FIG. 1 etc., two safety units 10 are respectively arranged on both sides of the elevator car 20, wherein the trigger 11, the safety device 12 and the force amplifying device 13 may be directly installed on the elevator car 20, for example, the trigger 11 and the safety device 12 may be respectively installed at the top, the side lower part of the elevator car 20, or any other suitable positions.

In specific use, for these simultaneously configured safety units 10, it is possible that there may be problems of being not able to operate synchronously, which may be caused by the failure occurred to one or several of the triggers 11 (for example, failure in triggering to work, relative delay in triggering to work, etc.). In the technical solution according to the present disclosure, the issues caused by the aforementioned synchronization problem can be overcome by optionally providing a synchronization device 14.

With reference to FIGS. 1, 2 and 3, the synchronization device 14 may be arranged between two or more safety units 10 for cooperation, thereby enabling each safety device 12 in these safety units 10 synchronously receives the acting force F2 transmitted out from the corresponding force amplifying device 13, and then synchronously performs safe operation on the elevator equipment.

As an exemplary illustration, in the given embodiments, the synchronization device 14 may comprise two connecting arms 141 and a connecting bar 142. Wherein, each connecting arm 141 has a first end 1411 and a second end 1412. The first end 1411 will be installed and connected between the corresponding force amplifying device 13 and the safety device 12. For example, the force amplifying device 13 and the corresponding part of the safety device 12 may be connected to the first end 1411 (such as the slot 1413), while the second end 1412 will be installed and connected to the connecting bar 142. By means of the connecting bar 142, it can actuate these connecting arms 141 and further these corresponding safety devices 12 connected therewith respectively to form synchronized coordinated operation together, which can effectively solve the problems in synchronous operation of the existing safety gear and other devices that have not been able to solve for a long time.

In addition, it should also be noted that even in the unfavorable event that some of the multiple safety units 10 that are being used fail, it is also possible to make the safety units 10 therein that are still normally operable to finally complete the corresponding elevator safety operation such as realizing the deceleration of the elevator car and the stop of the elevator car, etc. by the synchronization device 14, thus further improving the operational reliability of the entire elevator system and achieving a better safety performance.

As shown in FIG. 1, as an optional situation, the connecting bar 142 in the synchronization device 14 may be arranged to pass through the bottom frame 21 of the elevator car 20. By adopting this arrangement, it can not only make full use of existing equipment space and make it easy for installation and maintenance operations, but also do not bring forth more complex additional design and adaptation costs.

According to the technical solution of the present disclosure, it also provided elevator equipment. Specifically, the elevator equipment may comprise an elevator hoistway with guide rails, one or more elevator cars running in the elevator hoistway along the guide rails, and the elevator safety system designed and provided according to the present disclosure as described above. Once the triggers in the elevator safety system are triggered, the acting force output from the triggers will be amplified by the force amplifying device and transmitted to the safety device, so that the latter performs safe operations to the elevator car after receiving the force, such as decelerating the elevator car, stopping the elevator car, etc., which will effectively enhance the safety performance of the elevator equipment, improve the quality level and product competitiveness.

The elevator safety system and elevator equipment according to the present disclosure have been elaborated above in detail by way of example only. These examples are merely used to illustrate the principle and embodiments of the invention, rather than limiting the present disclosure. Various modifications and improvements may be made by those skilled in the art without departing from the spirit and scope of the invention. For example, the force amplifying device in the elevator safety system may also adopt other feasible ways such as motors and hydraulic mechanisms. Therefore, all equivalent technical solutions should fall within the scope of the present disclosure and be defined by the claims of the present disclosure.

What is claimed is:

1. An elevator safety system, comprising a safety unit having a safety device and a trigger, the trigger is connected with the safety device and the trigger outputs an acting force from an output end to the safety device for actuating the safety device to perform safety operation to the elevator, wherein the safety unit further comprises a force amplifying device provided between the trigger and the safety device for amplifying the acting force output from the output end and then transmitting the amplified acting force to the safety device;

wherein the force amplifying device is a rack and gear transmission mechanism, which comprises:

a gear set having at least a first gear and a second gear;

a first rack meshed with the first gear and connected with the output end; and a second rack meshed with the second gear and connected with the safety device to transmit the amplified acting force thereto.

2. The elevator safety system according to claim 1, wherein the rotation shaft of the first gear and the rotation shaft of the second gear are coaxial, and the gear diameter ratio between the first gear and the second gear is greater than 1.

3. The elevator safety system according to claim 1, wherein the first gear and the second gear are meshed with each other and their respective rotation shafts are parallel and the gear ratio between the first gear and the second gear is less than 1.

4. The elevator safety system according to claim 1, wherein the first rack has a slot extending in its length direction, and the output end has a connecting part for matching the slot to make the output end slidably connected with the first rack through the slot.

5. The elevator safety system according to claim 1, wherein the second rack has a hole through which the safety device is connected to the second rack.

6. The elevator safety system according to claim 1, wherein the elevator safety system is provided with at least two safety units.

7. The elevator safety system according to claim 6, wherein the elevator safety system further comprises a synchronization device arranged between the at least two safety units for enabling the safety devices in the at least two safety units to synchronously receive the amplified acting force transmitted from the corresponding force amplifying devices respectively and perform safety operation to the elevator.

8. The elevator safety system according to claim 7, wherein the synchronization device comprises:

at least two connecting arms, each connecting arm having a first end installed and connected between the corresponding force amplifying device and safety device in the at least two safety units, and a second end; and a connecting bar connected with the respective second ends of the at least two connecting arms.

9. The elevator safety system according to claim 8, wherein the elevator safety system has a first safety unit and a second safety unit, which are respectively arranged on two sides of an elevator car, and the connecting bar traverses through a bottom frame of the elevator car.

10. The elevator safety system according to claim 1, wherein the safety device, the trigger, and the force amplifying device are provided on an elevator car, and the trigger is configured to be triggered in response to change of elevator operation parameters.

11. An elevator equipment, comprising:

an elevator hoistway with a guide rail;

at least one elevator car arranged to run in the elevator hoistway along the guide rail; and the elevator safety system according to claim 1, which is configured to perform safety operation to the elevator car by the safety device in the elevator safety system.

* * * * *